US007399109B2

(12) United States Patent
Cheng

(10) Patent No.: US 7,399,109 B2
(45) Date of Patent: Jul. 15, 2008

(54) BULB ASSEMBLY WITH DUAL CONNECTING TYPES

(76) Inventor: Chao-Mu Cheng, No. 17, Alley 27, Lane 222, Min Sen Road, Hsinchu City (TW)

( * ) Notice: Subject to any disclaimer, the term of this patent is extended or adjusted under 35 U.S.C. 154(b) by 0 days.

(21) Appl. No.: 11/372,018

(22) Filed: Mar. 10, 2006

(65) Prior Publication Data

US 2007/0211497 A1 Sep. 13, 2007

(51) Int. Cl.
*F21V 21/00* (2006.01)

(52) U.S. Cl. ..... 362/644; 362/806; 362/640; 362/652; 439/613

(58) Field of Classification Search ..... 362/657, 362/654, 806, 226; 439/619
See application file for complete search history.

(56) References Cited

U.S. PATENT DOCUMENTS 3,522,579 A * 8/1970 Matsuya ..... 439/619
5,209,668 A * 5/1993 Higano et al. ..... 439/57
6,113,430 A * 9/2000 Wu ..... 439/619
6,774,549 B2 * 8/2004 Tsai et al. ..... 313/318.01
6,878,015 B2 * 4/2005 Fan ..... 439/699.2
7,153,019 B2 * 12/2006 Kuo ..... 362/657

* cited by examiner

*Primary Examiner*—Anabel M Ton
(74) *Attorney, Agent, or Firm*—Rosenberg, Klein & Lee

(57) ABSTRACT

A bulb assembly includes a shell, a holder, and a bulb, wherein the bulb and the holder are received in the shell, wherein the bulb has two conductive wires passing through the holder and being folded upward outsides. The shell is provided with a central plate extending to the bottom of the holder and separating two conductive wires from each other. Hence, there are two connecting types for electrical wires with conductive pins to insert into shell and contact with various position of the conductive wires that facilitates the utilization of the products.

3 Claims, 4 Drawing Sheets

BULB ASSEMBLY WITH DUAL CONNECTING TYPES

BACKGROUND OF THE INVENTION

Referring to FIGS. 1 to 3, a traditional bulb assembly includes a bulb (1), a holder (2), and a shell (3). The bulb (1) is received in the holder (2), and both of them are again received in the shell (3). The bulb (1) has two conductive wires (11), each of which passes through the holder (2) and then is folded upward outside the holder (2). Two electrical wires (4) connect with relating conductive pins (5) to insert into the shell (3) from its bottom end. The pin (5) is placed between outside end of the conductive wire (11) and inner face of the shell (3) to form an electrical connection.

The present invention is to provide an improved bulb assembly with dual connecting types that facilitates the application for some decorative lighting strings. Now, accompanying with drawings, the character and structure of the present invention will be disclosed as following.

DETAILED DESCRIPTION OF THE PREFERRED EMBODIMENT

Figure 1:
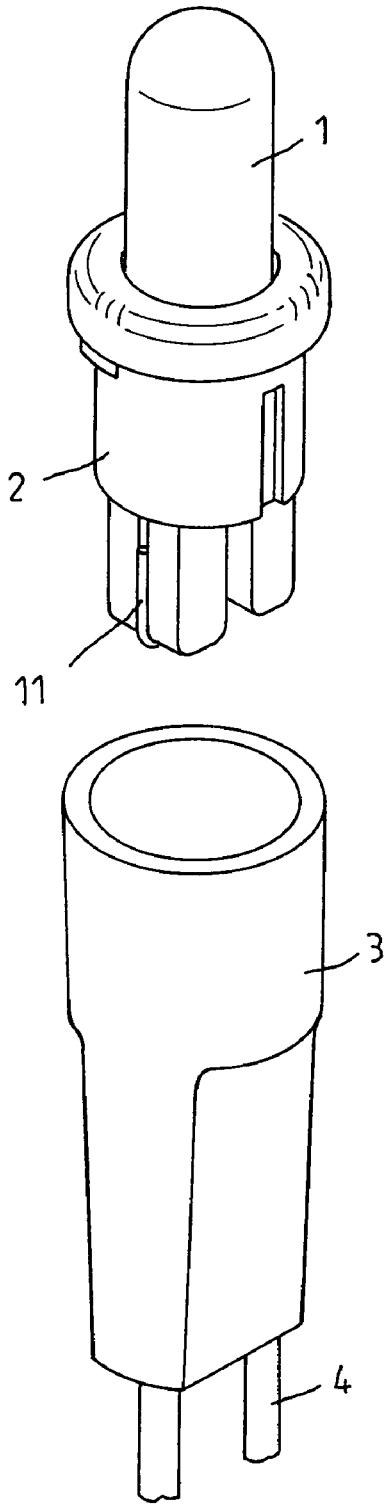
FIG. 1 is a perspective view showing a normal bulb assembly.
Figure 2:
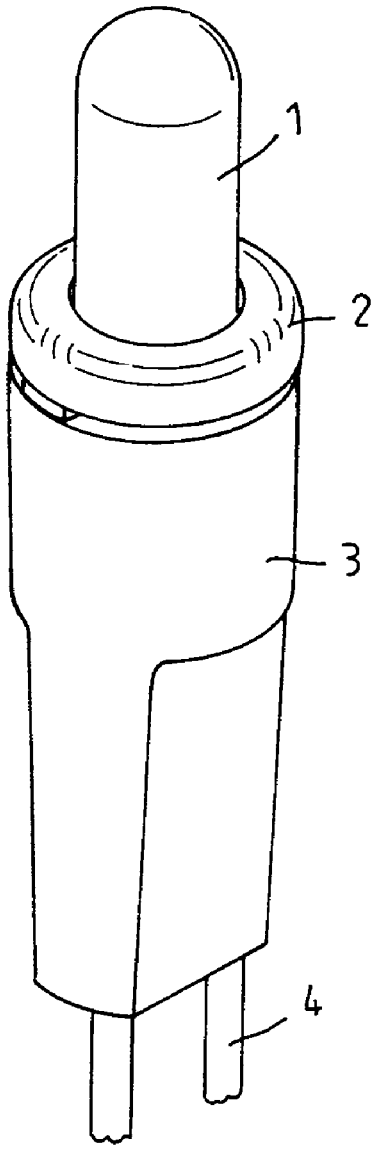
FIG. 2 is an exploded perspective view showing a traditional bulb assembly.
Figure 3:
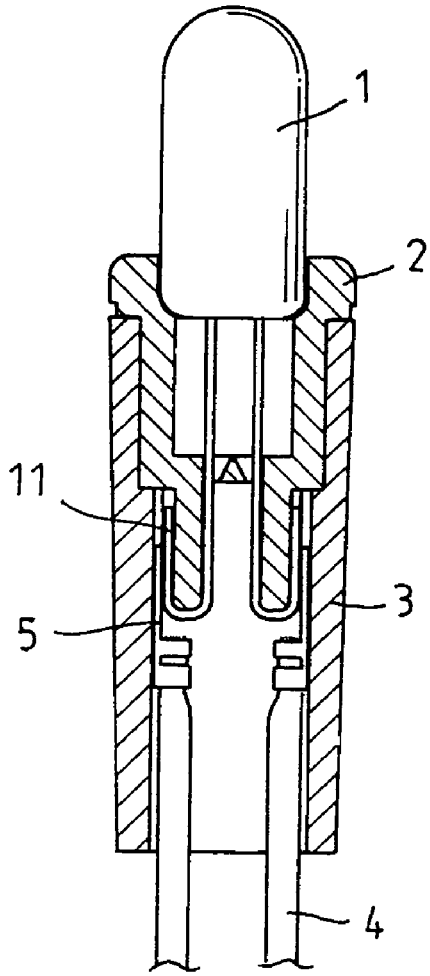
FIG. 3 is a cross-sectional plan view of FIG. 1.
Figure 4:
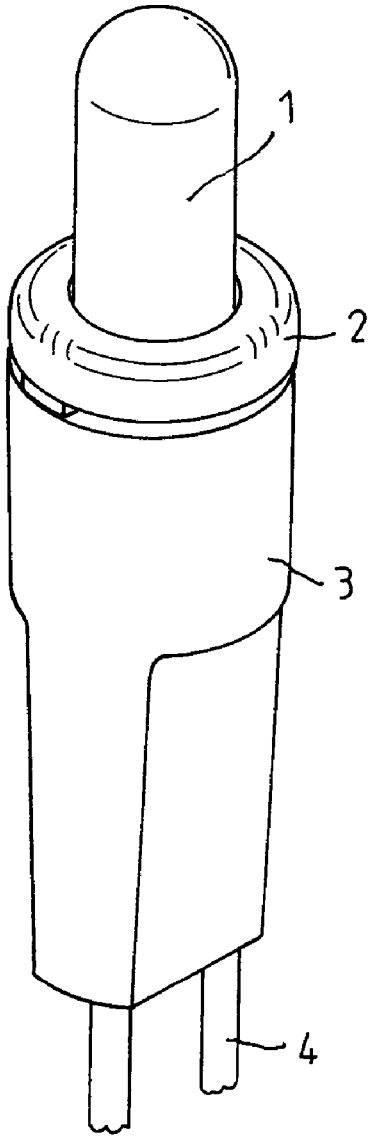
FIG. 4 is an exploded perspective view showing a bulb assembly in a certain connecting type according to the present invention.
Figure 5:
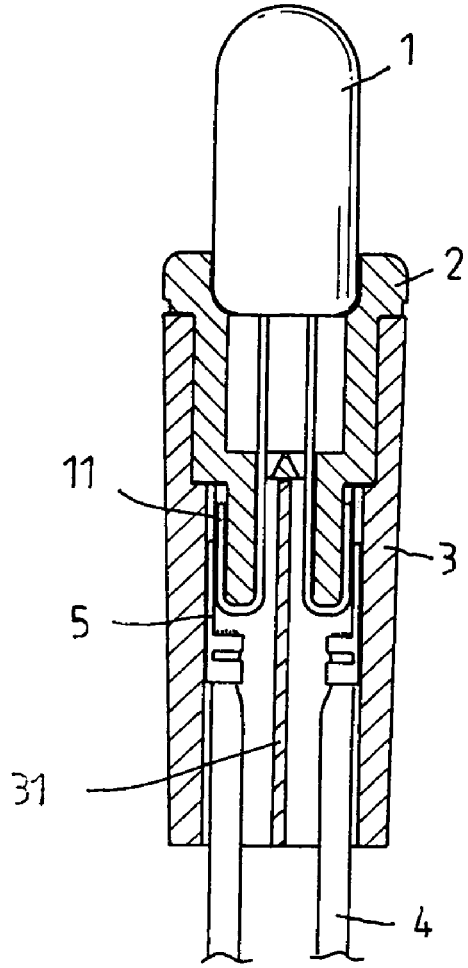
FIG. 5 is a cross-sectional plan view of FIG. 4.

Please refer to FIGS. 4 and 5 first; the present invention includes a shell (3), a holder (2), and a bulb (1), wherein the bulb (1) has two conductive wires (11) passing through the holder (2) and being folded upward outsides. The characteristic of the present invention is that the shell (3) is provided with a central plate (31) extending to the bottom of the holder (2) that separates two conductive wires (11) from each other. As in usual, two electrical wires (4) with relating conductive pins (5) are inserting into the shell (3) and contacting with outer ends of the conductive wires (11) respectively.

Figure 6:
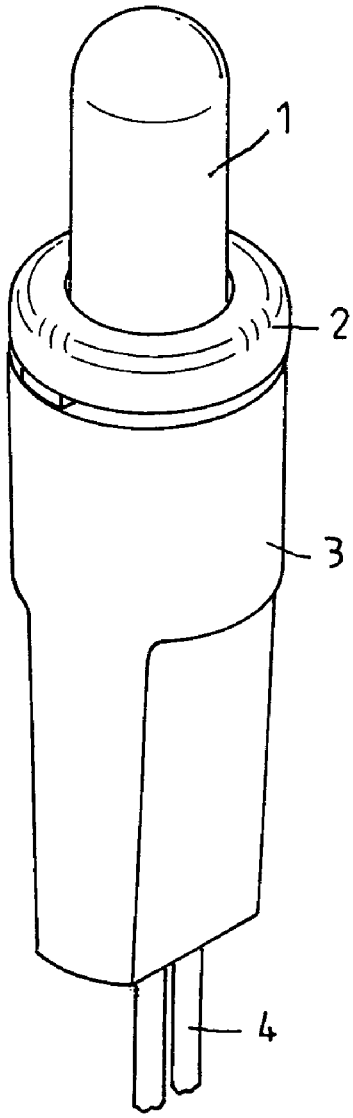
FIG. 6 is an exploded perspective view showing a bulb assembly in another connecting type according to the present invention.
Figure 7:
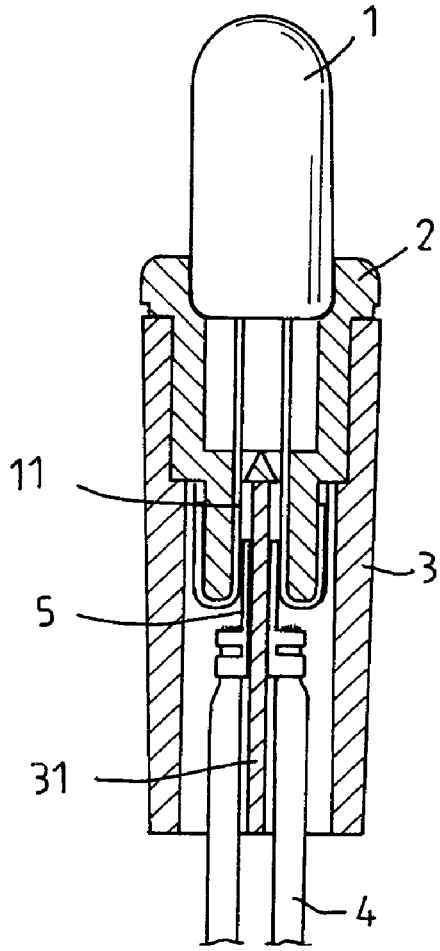
FIG. 7 is a cross-sectional plan view of FIG. 6.

Referring to FIGS. 6 and 7, the bulb assembly of the invention can be applied in another way. In this application, the pin (5) of the electrical wire (4) is inserted into the shell (2) alone the central plate (31) and contacts with middle portion of the conductive wire (11). Hence, the distance between two electrical wires (4) is small than the former application.

Accordingly, the present invention can provide two connecting types for facilitating the utilization of user that, therefore, makes improvement and effects and should be allowed for a patent.

I claim:

1. A bulb assembly for adaptive coupling to electrical wires comprising:

a shell, a holder, and a bulb, the bulb having two conductive wires passing through the holder and being folded upward and outside about a pair of spaced bottom projections thereof;

the shell being provided with a central plate extending upwardly to the bottom of the holder between the bottom projections, the central plate separating the two conductive wires of the bulb from each other and separating two conductive pins coupled to corresponding electrical wires from each other, the conductive pins being respectively inserted into the shell on opposing sides of the central plate between outer ends of the conductive wires and an inner face of the shell or between middle portions of the conductive wires and the central plate, either insertion configuration thereby providing an electrical connection between the conductive wires of the bulb and the electrical wires.

2. A bulb assembly for adaptive coupling to electrical wires comprising:

a shell;

a holder having a pair of spaced bottom projections;

a bulb having a pair of conductive wires passing through the holder, a middle portion of each of the conductive wires extending downward from the bulb, an arcuate portion extending along one of the bottom projections of the holder and an end portion extending outwardly and upward about the bottom projection; and, a central plate extending between the bottom projections of the holder and separating the two conductive wires from each other;

whereby a conductive pin is coupled to each of two electrical wires and is captured within the shell between the end portions of the conductive wires and an inner face of the shell or between the middle portions of the conductive wires and the central plate, either capture configuration thereby providing an electrical connection between the conductive wires of the bulb and the electrical wires.

3. A bulb assembly for coupling to electrical wires comprising:

a shell, a holder, and a bulb, the bulb having two conductive wires passing through the holder and being folded upward and outside about a pair of spaced bottom projections thereof;

the shell being provided with a central plate extending upwardly to the bottom of the holder between the bottom projections, the central plate separating the two conductive wires of the bulb from each other and separating two conductive pins of corresponding electrical wires from each other, the conductive pins being respectively inserted into the shell on opposing sides of the central plate between portions of the conductive wires of the bulb and the central plate, whereby the electrical wires are closely spaced.

* * * * *